United States Patent [19]

Vinoski

[11] Patent Number: 4,919,800

[45] Date of Patent: Apr. 24, 1990

[54] FLUSHING MEANS FOR A MARINE ENGINE

[76] Inventor: Todd Vinoski, 537 NE. 137th St., North Miami, Fla. 33161

[21] Appl. No.: 248,595

[22] Filed: Sep. 26, 1988

[51] Int. Cl.[5] ..... B01D 35/00

[52] U.S. Cl. ..... 210/94; 210/171; 210/203; 210/416.1; 210/452; 210/497.01; 440/88; 134/169 A

[58] Field of Search ..... 210/240, 407, 409, 435, 210/159, 162, 251, 254, 209, 220, 416.1, 448, 452, 418, 427, 203, 443, 444, 451, 497.01, 94, 171; 440/88, 89; 137/240; 134/169 A

[56] References Cited

U.S. PATENT DOCUMENTS

| | | | |
|---|---|---|---|
| 1,630,223 | 5/1927 | Stiehm | 210/443 |
| 2,275,750 | 3/1942 | Genetti et al. | 210/251 |
| 3,063,566 | 6/1959 | Hanley | 210/247 |
| 3,250,397 | 5/1966 | Moltchan | 210/443 |
| 3,550,612 | 10/1970 | Maxon | 137/240 |
| 4,051,042 | 9/1977 | Tullier et al. | 210/409 |
| 4,082,676 | 4/1978 | Dulger | 210/451 |
| 4,121,948 | 10/1978 | Guhlin | 440/88 |
| 4,379,058 | 4/1983 | Bolton | 210/171 |
| 4,589,851 | 5/1986 | Karls | 440/88 |
| 4,619,618 | 10/1986 | Patti | 440/88 |
| 4,729,393 | 3/1988 | Ferguson | 440/88 |

*Primary Examiner*—W. Gary Jones
*Assistant Examiner*—Matthew O. Savage

[57] ABSTRACT

A novel cooling system for an internal-combustion marine engine employs a novel strainer having a removable metal cover and means for controllably introducing flushing liquid into the strainer through the cover. A prior strainer may be modified by providing an auxiliary aperture through the cover and attaching one end of an auxiliary pipeline to the aperture. The auxiliary pipeline includes a hose-connection fitting at its other end and a control valve in the line.

6 Claims, 1 Drawing Sheet

FLUSHING MEANS FOR A MARINE ENGINE

BACKGROUND OF THE INVENTION

1. Field of the Invention

This invention relates to a novel means for flushing the cooling system for a liquid-cooled, internal combustion, marine engine, and particularly to a novel and improved strainer for use in such system. The invention includes a novel cooling system employing the novel strainer.

2. Description of the Prior Art

A liquid-cooled, internal combustion marine engine is cooled by drawing external water in through a coolant intake pipeline, circulating it through the engine block and then discharging it with the exhaust gas from the engine. The external water, be it water from an ocean, a river, a lake, or the like, is ordinarily contaminated with soluble salts and minerals and often contains abrasive particles, such as silt and sand.

Many prior coolant intake pipelines include a strainer that is adapted to collect organic material and solid particles before they enter the engine block. A typical pipeline strainer includes a container having an inlet port, an outlet port and a cleanout aperture; a metal mesh basket in the container; a removable metal cover for closing the cleanout aperture; and means for clamping the cover over the cleanout aperture.

If external water is allowed to remain in the engine block and/or in the coolant intake pipeline for a prolonged period of time, the metal parts thereof are likely to corrode and require costly replacements and repairs, and/or engine failure. To avoid this, it is common practice to flush the engine and intake pipeline with fresh water at frequent intervals before storing the engine, and often during storage. Many boat owners flush the cooling system with fresh water or other liquid coolant after every use of the engine.

Several expedients have been suggested to reduce the time and effort required to flush the cooling system for a marine engine. U.S. Pat. No. 3,550,612 to L. J. Maxon and U.S. Pat. No. 4,619,618 to W. Patti suggest installing a T-fitting in the coolant intake line, and injecting fresh water through the T-fitting when fresh-water flushing is desired. Such modifications to the cooling system are relatively expensive and do not reduce substantially the time and effort required for flushing. U.S. Pat. No. 4,121,948 to K. G. Guhlin; U.S. Pat. No. 4,589,851 to M. A. Karls; and U.S. Pat. No. 4,729,393 to J. A. Ferguson suggest clamping the fixture over the coolant intake port of the cooling system, and then injecting fresh water through the fixture when fresh-water flushing is desired. While these arrangements do not modify the cooling system, they require considerable time and effort to set up, and are not practical for use while the boats remain in the water.

OBJECTS OF THE INVENTION

An object of this invention is to provide a novel means for flushing the cooling system of a liquid-cooled, internal combustion marine engine.

Another object is to provide a novel and improved strainer for the cooling system of a marine engine, which strainer is modified to be capable of controllably introducing flushing liquid into the system.

A further object is tho provide a cooling system for an internal combustion marine engine having novel means for controllably introducing flushing liquid into the system.

A still further object is to provide a cooling system for a marine engine having integral means for flushing the cooling system, which flushing means do not require substantial modification to an existing cooling system, and which may be operated effectively with a boat either in or out of the water.

SUMMARY OF THE INVENTION

The novel cooling system employs a novel strainer comprising a container having a removable metal cover and means for controllably introducing flushing liquid into the strainer through the cover. A prior strainer may be modified by providing an auxiliary aperture through the cover and attaching one end of an auxiliary pipeline to the cover at the auxiliary aperture. The auxiliary pipeline includes a hose-connection fitting at its other end, and a control valve in the line. The novel cooling system comprises the prior cooling system modified by the addition of the flushing liquid introducing means operatively connected to the cover of the strainer.

The novel cooling system and novel strainer do not require any substantial modification to an existing system or strainer. Only an aperture need be provided in the strainer cover. The auxiliary pipeline employs few, readily-available parts which are easily assembled to the strainer cover. Hence, the modifications required to provide the novel strainer and cooling system are low in cost and simple in structure.

The novel cooling system and novel strainer are simple and easy to operate as they only require connection of a hose and the opening of the control valve. Also, the novel cooling system can be flushed with the boat in or out of the water.

DETAILED DESCRIPTION OF THE DRAWINGS INCLUDING THE PREFERRED EMBODIMENTS

Figure 1:
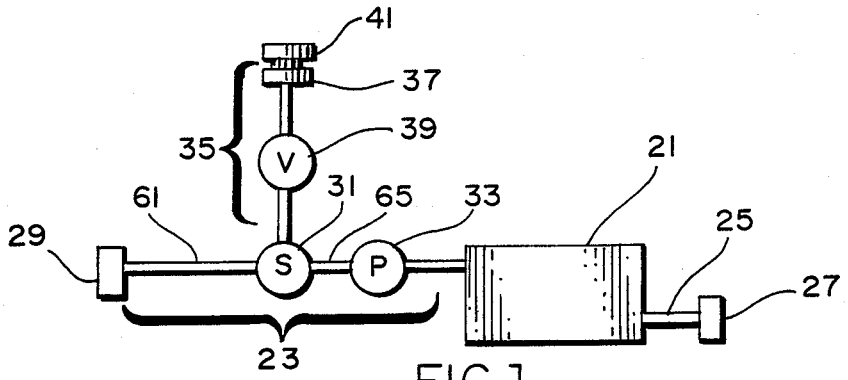
FIG. 1 is a schematic diagram of the novel cooling system including the novel means for flushing the system with flushing liquid.

The following description of some of the preferred embodiments of the concepts of this invention is made in reference to the accompanying figures. Where an individual structural element is depicted in more than one figure, it is assigned a common reference numeral for simplification of identification and understanding.

FIG. 1 shows schematically the novel cooling system for a water-cooled, internal combustion engine. The novel system comprises the engine block 21 to be cooled, a coolant intake pipeline 23 connected to the block 21, and exhaust line 25 and exhaust port 27 connected to the block 21. The intake pipeline 23 includes a coolant intake port 29, a coolant strainer 31 and a pump 33 connected in that order to the engine block 21. The engine may be of the inboard or outboard type, but must include a strainer or filter for the coolant liquid. The coolant liquid may be water from an ocean, a sea, a lake, a river, or the like; and may contain dissolved, particulate and/or organic matter before being drawn into the intake pipeline. In ordinary operation, with the boat (not shown) in water and the engine running, the pump 33 draws liquid coolant into the pipeline 23 through the intake port 29 and then through the strainer 31. The pump 33 then forces the coolant through the engine block 21 and the exhaust line 25, and out of the exhaust port 27 with the exhaust gases from the engine.

The coolant intake pipeline 23 is modified by providing a means for controllably introducing flushing fluid into the strainer 31 through the metal cover on the strainer 31. The flushing fluid is usually fresh water from the top, but may be deionized water, or fresh or deionized water to which anti-corrosion chemicals have been added.

The introducing means shown in FIG. 1 comprises an auxiliary pipeline 35 connected at one end to the cover on the strainer 31, having a hose-connection fitting 37 at its other end, and having operation described above, there is a closure cap 41 closing the hose-connection fitting 37. For flushing operation, the closure cap 41 is replaced with the end of the flushing-liquid supply hose (not shown) and the valve 39 is positioned to the desired opening. Then, with the pump 33 running, the flushing liquid is drawn through the valve 39, the strainer 33 and discharged through the engine block 21 and exhaust port 27. When in the water, it is common practice to close the system to existing seawater by means of a valve located between the strainer 31 and the hull of the boat (not shown). If the boat is out of the water, a portion of the flushing liquid will pass from the strainer 31 out through the intake port 29.

Figure 2:
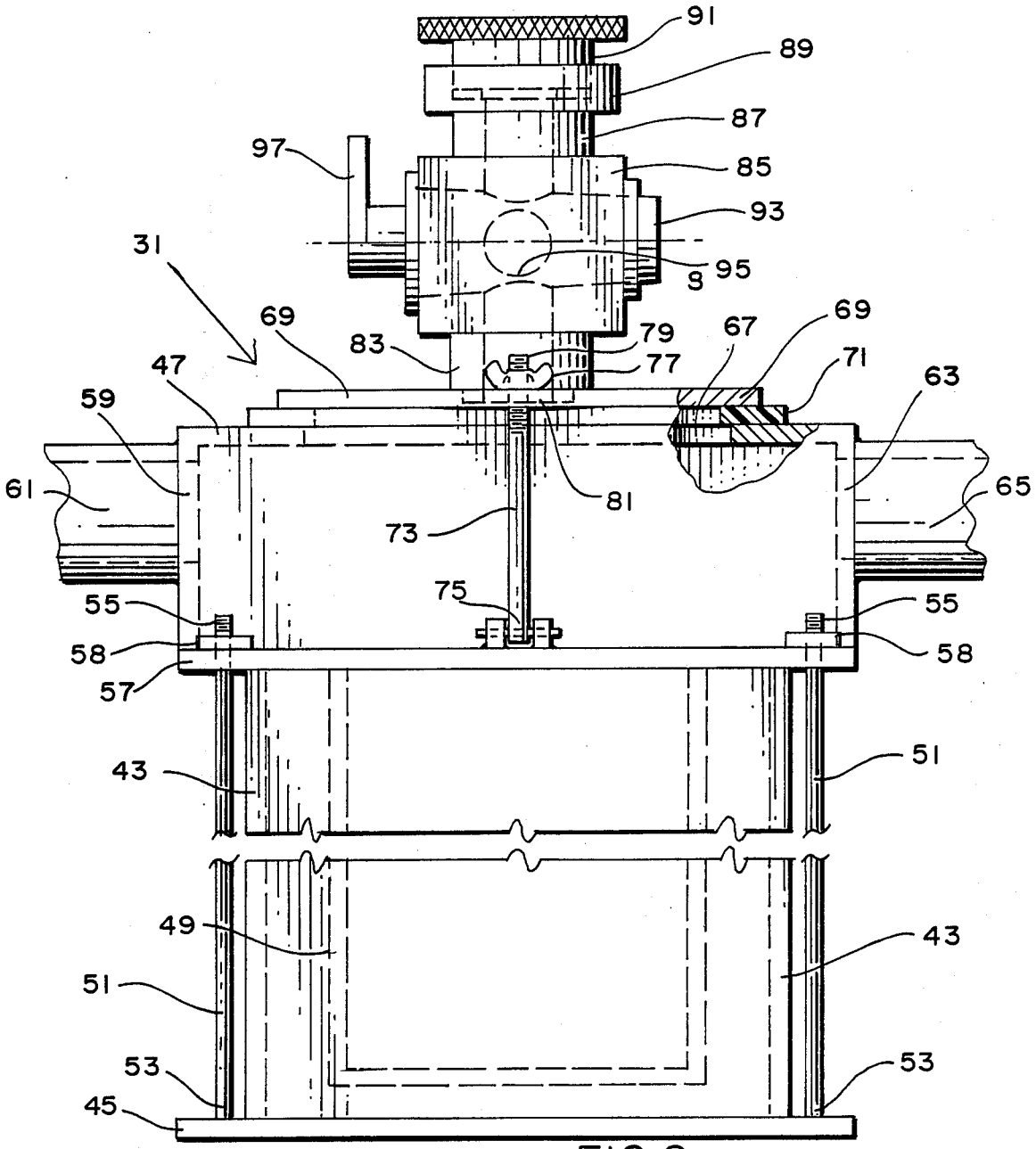
FIG. 2 is a partially broken-away elevational view of the coolant strainer and auxiliary pipeline for introducing flushing liquid into the cooling system shown in FIG. 1.

A preferred embodiment of the novel strainer 31 including the auxiliary pipeline 35 is shown in FIG. 2. The strainer 31 prior to modification is a PERKO Intake Water Strainer, marketed by PERKO, INC. Any of the PERKO strainers, which are available in eight standard sizes and three heavy-duty sizes, may be used. Each of these strainers comprises a transparent cylinder 43, a metal bottom wall 45 closing one end of the cylinder 43 and a metal top wall 47 closing the other end of the cylinder 43. There is a metal mesh basket 49 inside the cylinder 43. There are four spaced draw rods 51, each of which is threaded at one end 53 thereof and screwed into spaced threaded apertures in the bottom wall 45. The other end 55 of each draw rod 51 is threaded and passes through an aperture in a flange 57 of the top wall 47. The bottom wall 45 and top wall 47 are drawn together with the cylinder 43 between with nuts 58, forming a container for holding the basket 49.

The top wall 47 has an inlet port 59 connected by an inlet pipe 61 to the intake port 29 (FIG. 1), and an outlet port 63 connected by an outlet pipe 65 to the pump 33 (FIG. 1). The top wall 47 also has a cleanout aperture 67 through which the basket 49 can be removed and reinserted. The top wall 47 includes a removable metal cover 69 with a gasket 71 there between. The metal cover 69 is held in place over the cleanout aperture 67 with two clamping rods 73 that are hingedly mounted to the flanges 57 on opposite sides of the top wall 47 at the one end 75 thereof, and tightened down on the cover 69 with wing nuts 77 at the other end 79 thereof.

The strainer 31 is modified solely by drilling an auxiliary aperture 81 through the metal cover 69 and attaching the auxiliary pipeline 35 thereto. As shown in FIG. 2, a first ¾-inch pipe nipple 83 is threaded into the auxiliary aperture 81; the pipe may also be ½-inch. A plug valve 85 is connected to the first nipple 83. A second ¾-inch pipe nipple 87 is connected on the other side of the valve 85. A female hose-connector fitting 89 is connected to the end of the second nipple 87 and a male closure cap 91 is screwed into the female fitting 89. As shown in FIG. 2, the plug 93 of the valve 85 is closed with the valve opening 95 crosswise to the direction of flow of liquid therethrough. The valve 85 may be rotated to a partially open or fully open position with the handle 97 that is attached to the plug 93. By partially opening the valve 85, the amount of flushing liquid passing into the cooling system can be controlled.

Ordinarily, the only way to flush a cooling system having a PERKO-type water strainer is to remove the metal cover on the strainer and shove a hose down inside the strainer. The hose must be held by hand while flushing water is flowing in order to prevent the hose from falling out of the strainer, due to the pressure of the flushing water. These disadvantages are eliminated with the novel structure because the hose is physically attached to the hose-connection fitting.

Also, depending on how the strainer is mounted in the engine compartment, it may be difficult to remove the cover from the strainer, and also the gasket adjacent the cover may be damaged. These disadvantages are also eliminated with the novel structure because the cover is not removed.

The novel system makes it easier to maintain the marine engine by the daily user, the occasional user, and during storage during winter months when engines must be run from time to time. Also, the modification to the strainer does not interfere with the removal of the cover and basket from cleaning.

The foregoing figures and descriptions thereof are provided as illustrative of some of the preferred embodiments of the concepts of this invention. While these embodiments represent what is regarded as the best modes for practicing this invention, they are not intended as delineating the scope of the invention, which is set forth in the following claims.

What is claimed is:

1. A cooling system for a liquid-cooled internal combustion marine engine, said cooling system comprising a coolant intake pipeline connected at one end thereof to the engine block of said engine, a coolant strainer in said intake pipeline, said strainer comprising a container having a removable metal cover, an improvement comprising means for controllably introducing flushing liquid into said strainer through said cover.

2. The cooling system defined in claim 1 wherein said cover has an auxiliary aperture therein, and said introducing means includes an auxiliary pipeline connected at its auxiliary discharge end to said cover at said auxiliary aperture, said auxiliary pipeline including a hose-connection fitting at its auxiliary intake end, and an inlet valve between said auxiliary pipeline ends for controlling the flow of liquid therethrough.

3. The cooling system defined in claim 2 wherein said coolant intake pipeline includes a coolant intake end, a discharge end connected to said engine block, said strainer between said intake end and said discharge end, and a pump between said strainer and said coolant discharge end, said pump drawing coolant through said strainer.

4. The cooling system defined in claim 3 wherein said strainer includes a transparent cylinder, a metal bottom wall closing one end of said cylinder, a metal mesh basket in said cylinder, a metal top wall closing the other end of said cylinder, means for urging said top wall and bottom wall together with said cylinder therebetween, said top wall having a coolant inlet port, a coolant outlet port and a cleanout aperture therein, said metal cover being dimensioned so as to fit over and to close said cleanout aperture, and means for clamping said cover to said top wall over said cleanout aperture.

5. The cooling system defined in claim 3 wherein said metal cover has a threaded auxiliary aperture therein and said auxiliary pipeline includes a first threaded nipple between said auxiliary aperture and said valve, and a second threaded nipple between said valve and said hose-connection fitting.

6. The cooling system defined in claim 5 including a threaded cap for closing said hose-connection fitting.

* * * * *